US011598037B1

(12) United States Patent
Sterling

(10) Patent No.: US 11,598,037 B1
(45) Date of Patent: Mar. 7, 2023

(54) NEEDLE-THREADING DEVICE

(71) Applicant: Tiffany Sterling, Charlotte, NC (US)

(72) Inventor: Tiffany Sterling, Charlotte, NC (US)

( * ) Notice: Subject to any disclaimer, the term of this patent is extended or adjusted under 35 U.S.C. 154(b) by 370 days.

(21) Appl. No.: 16/940,464

(22) Filed: Jul. 28, 2020

(51) Int. Cl.
*D05B 87/02* (2006.01)
*A41G 5/00* (2006.01)

(52) U.S. Cl.
CPC ..... *D05B 87/02* (2013.01); *A41G 5/0086* (2013.01); *A41G 5/006* (2013.01)

(58) Field of Classification Search
CPC ..... D05B 87/00; D05B 87/02; D05B 87/04; A41G 5/0086
USPC ..... 223/99
See application file for complete search history.

(56) References Cited

U.S. PATENT DOCUMENTS 2,419,495 A * 4/1947 Lehmann ..... D05B 87/00 223/99
2,588,589 A 3/1952 Tauber
6,170,722 B1 1/2001 Huang
6,830,165 B2 12/2004 Tanaka
9,033,196 B1 5/2015 Smith
10,125,440 B1 11/2018 Jackson
D855,969 S 8/2019 Jackson
2017/0208886 A1 7/2017 White
2021/0355618 A1* 11/2021 Brundage ..... D05B 3/12

FOREIGN PATENT DOCUMENTS

CA 489557 1/1953

* cited by examiner

*Primary Examiner* — Nathan E Durham

(57) ABSTRACT

The needle-threading device is configured for use with a plurality of weave configured for use in sewing a hair weave. The needle-threading device: a) stores the plurality of weave needles; b) automatically threads each individual weave needle with a yarn; and, c) individually dispenses each threaded individual weave needle. The needle-threading device comprises a yarn feed, a threading mechanism, a needle mechanism, a housing, and a control circuit. The housing contains the yarn feed, the threading mechanism, the needle mechanism, and the control circuit. The control circuit controls the operation of the yarn feed, the threading mechanism, and the needle mechanism. The yarn feed provisions the yarn required to thread each individual weave needle. The threading mechanism threads the yarn through the individual weave needle. The needle mechanism transports each individual weave needle as required through the hair weaving process.

16 Claims, 8 Drawing Sheets

NEEDLE-THREADING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of textiles including sewing, more specifically, a needle-threading device with mechanical means for moving thread through the needle eye.

Summary of Invention

The needle-threading device is a mechanical device. The needle-threading device is configured for use with a plurality of weave needles. Each individual weave needle selected from the plurality of weave needles is configured for use in sewing hair weaves. The needle-threading device stores the plurality of weave needles and automatically threads each individual weave needle with a yarn, and individually dispenses each threaded individual weave needle as required during the hair weaving process. The needle-threading device comprises a yarn feed, a threading mechanism, a needle mechanism, a housing, and a control circuit. The housing contains the yarn feed, the threading mechanism, the needle mechanism, and the control circuit. The control circuit controls the operation of the yarn feed, the threading mechanism, and the needle mechanism. The yarn feed provisions the yarn required to thread each individual weave needle. The needle mechanism: a) positions each individual weave needle to receive the yarn during the threading process; and, b) dispenses each individual weave needle as required during the hair weaving process. The threading mechanism threads the yarn through the individual weave needle.

These together with additional objects, features and advantages of the needle-threading device will be readily apparent to those of ordinary skill in the art upon reading the following detailed description of the presently preferred, but nonetheless illustrative, embodiments when taken in conjunction with the accompanying drawings.

In this respect, before explaining the current embodiments of the needle-threading device in detail, it is to be understood that the needle-threading device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the needle-threading device.

It is therefore important that the claims be regarded as including such equivalent construction insofar as they do not depart from the spirit and scope of the needle-threading device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
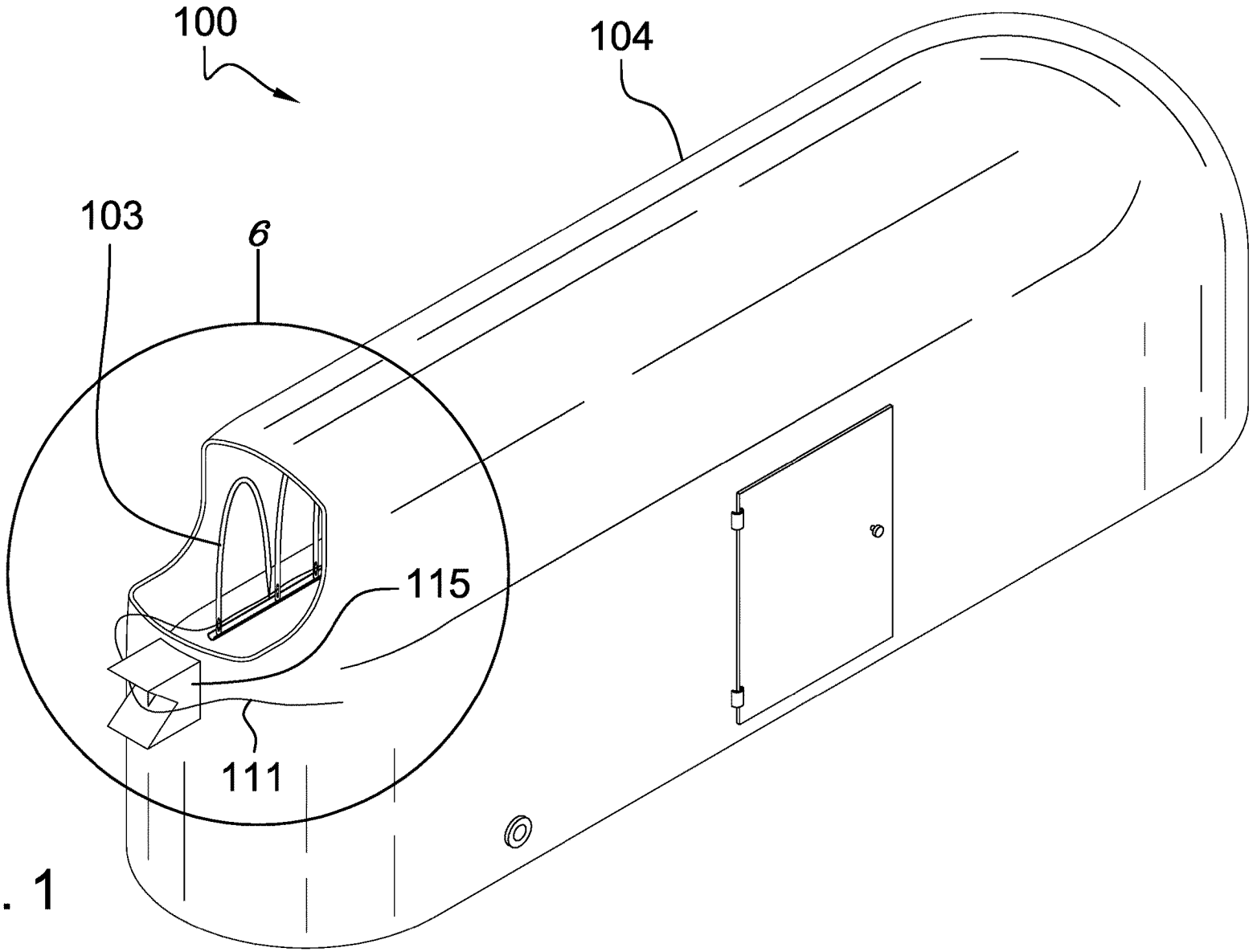
FIG. 1 is a perspective view of an embodiment of the disclosure.
Figure 2:
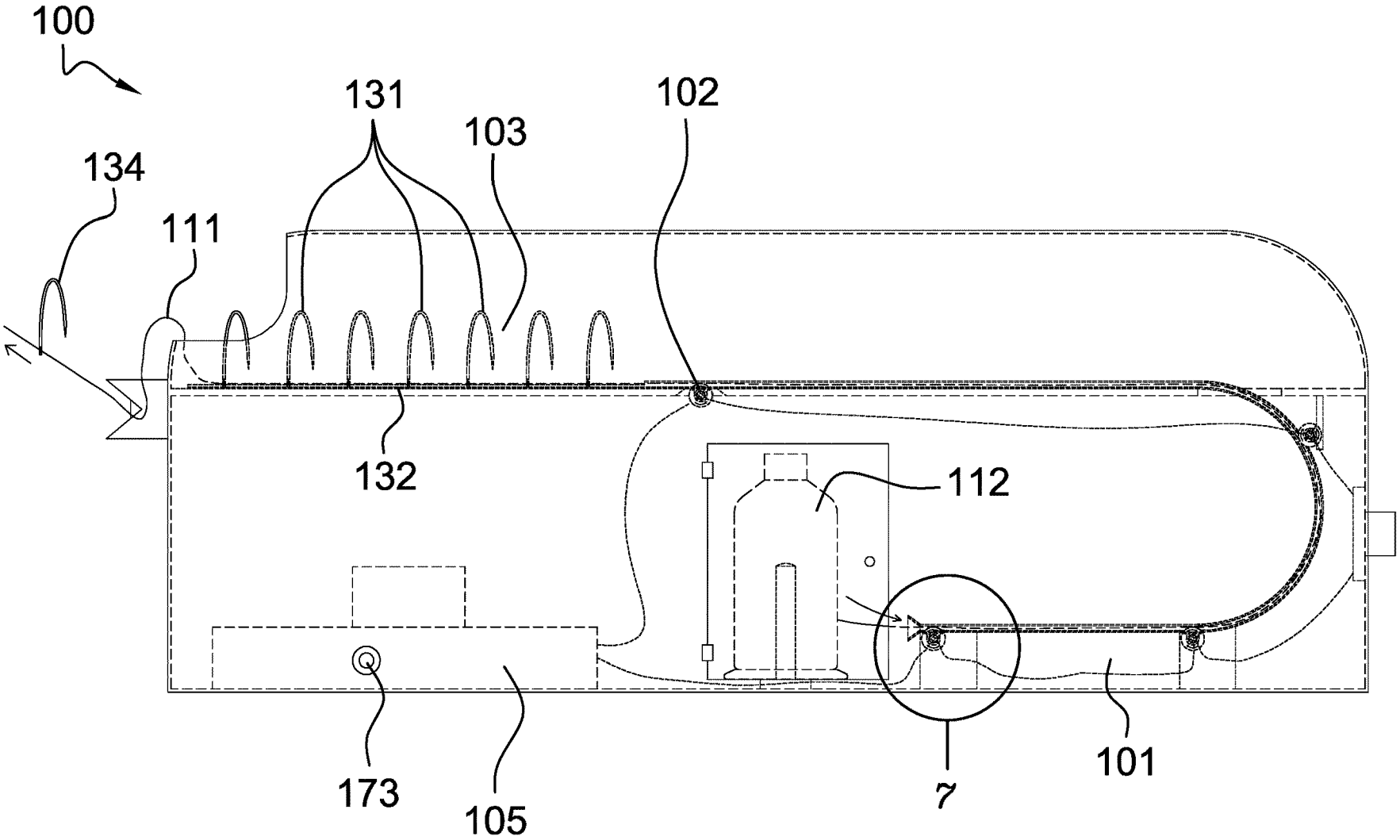
FIG. 2 is a front view of an embodiment of the disclosure.
Figure 4:
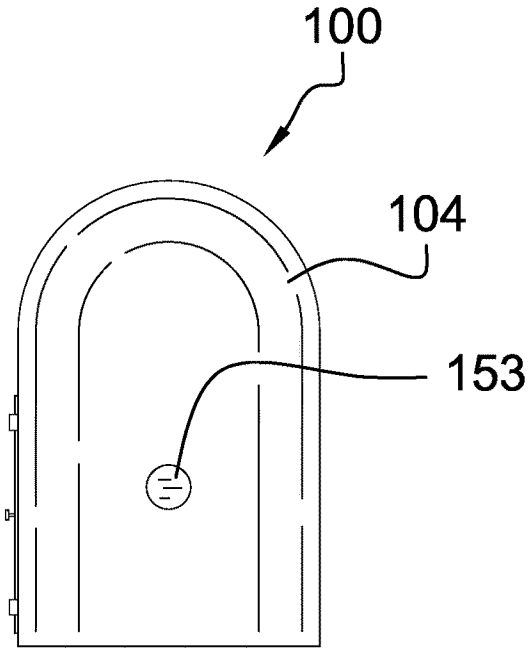
FIG. 4 is a reverse side view of an embodiment of the disclosure.
Figure 3:
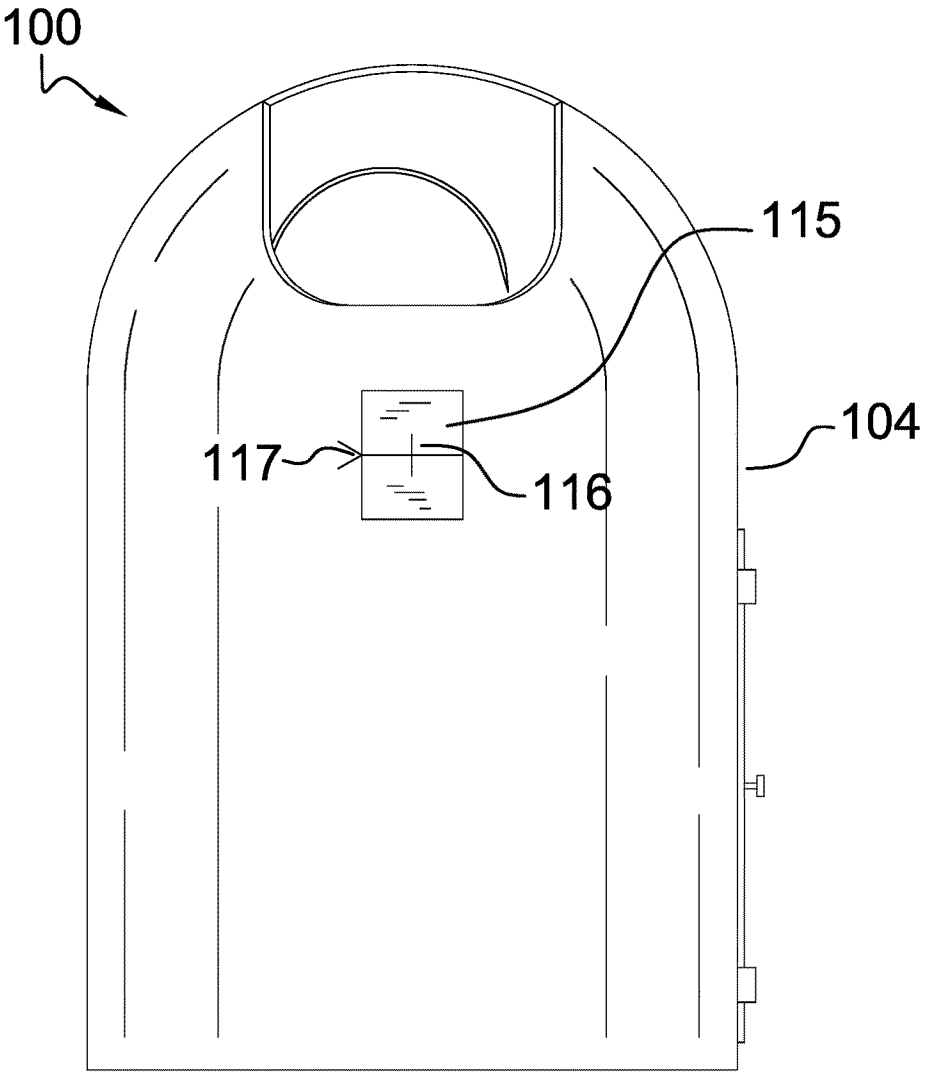
FIG. 3 is a side view of an embodiment of the disclosure.
Figure 5:
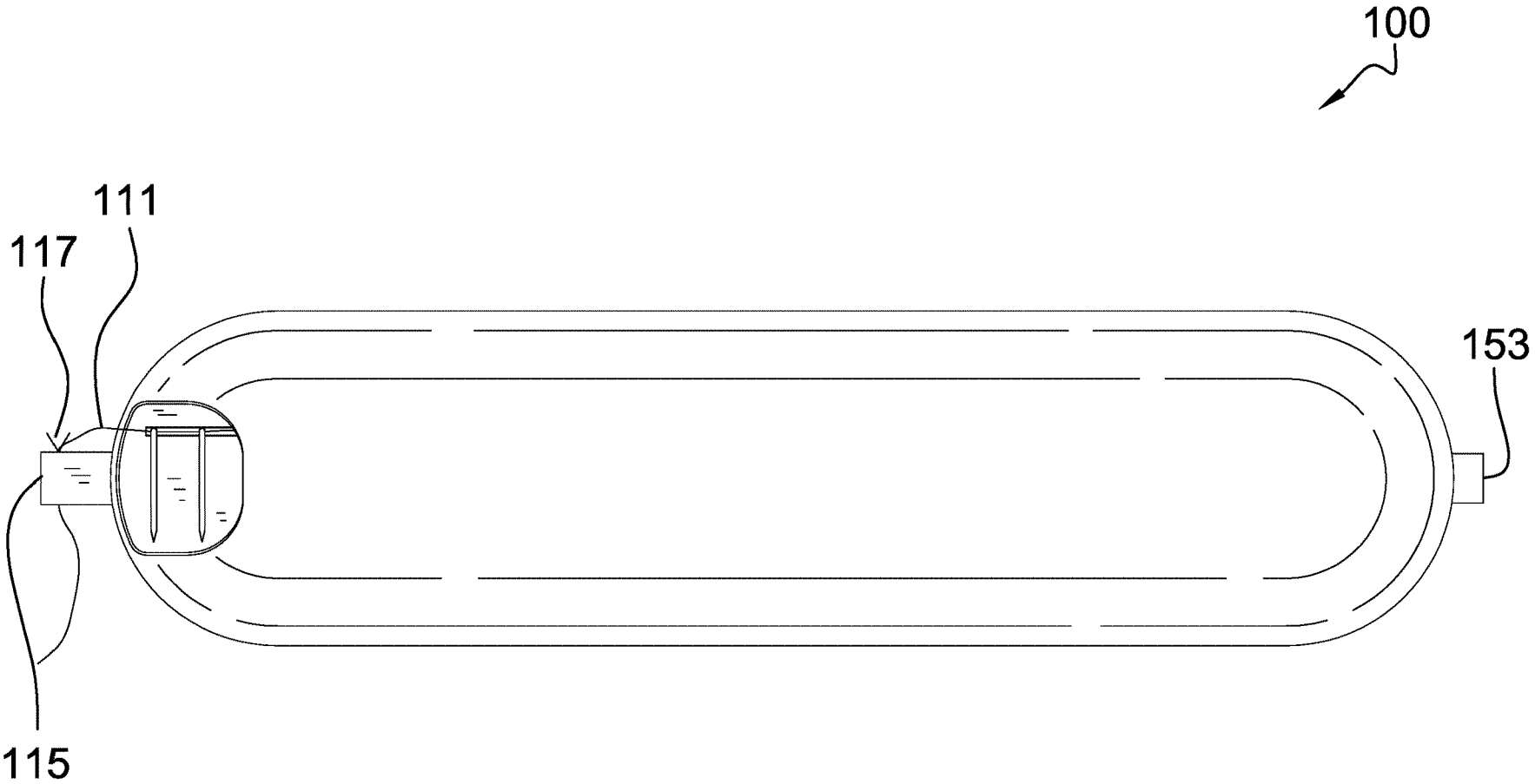
FIG. 5 is a top view of an embodiment of the disclosure.
Figure 6:
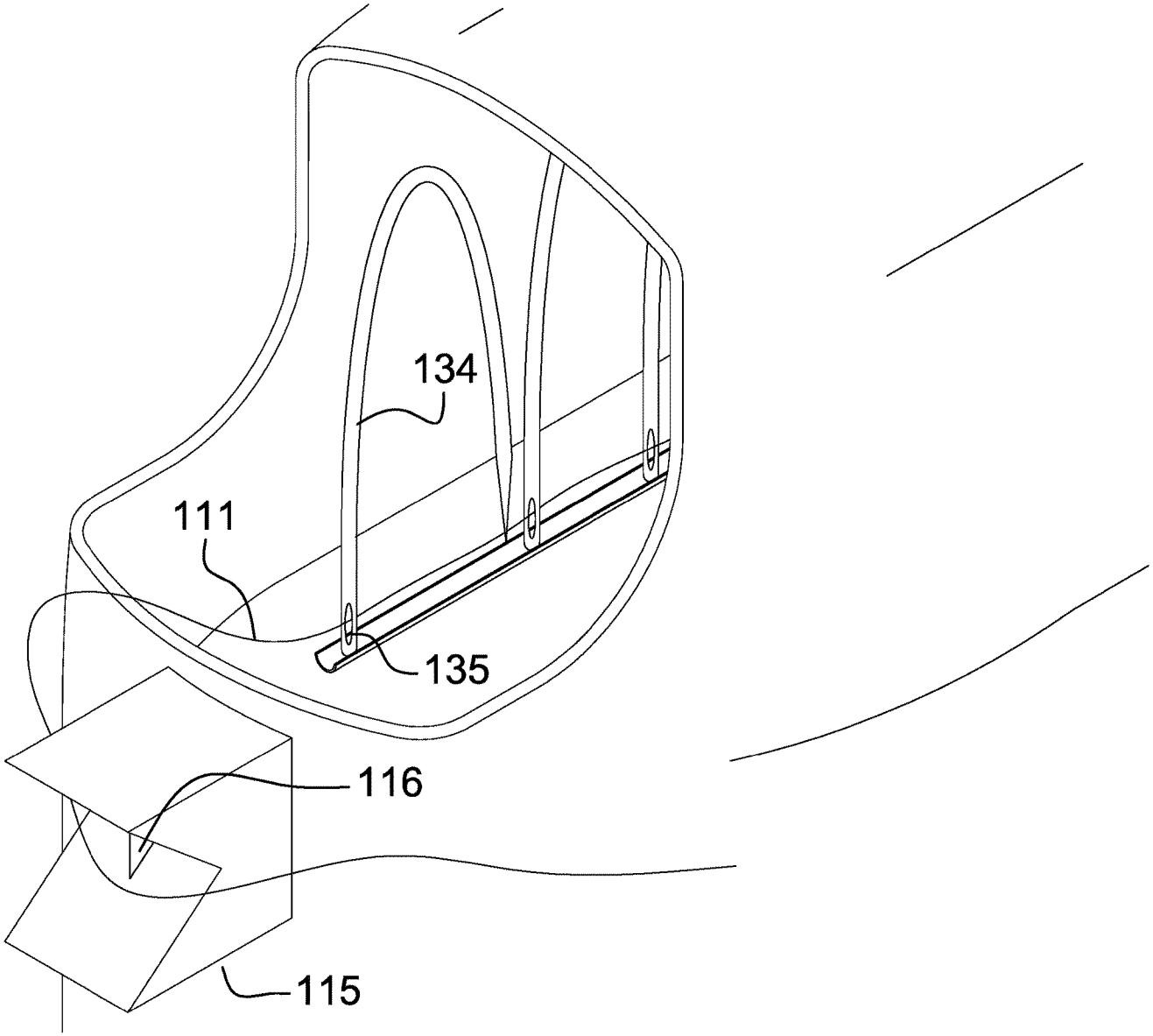
FIG. 6 is a detail view of an embodiment of the disclosure.
Figure 7:
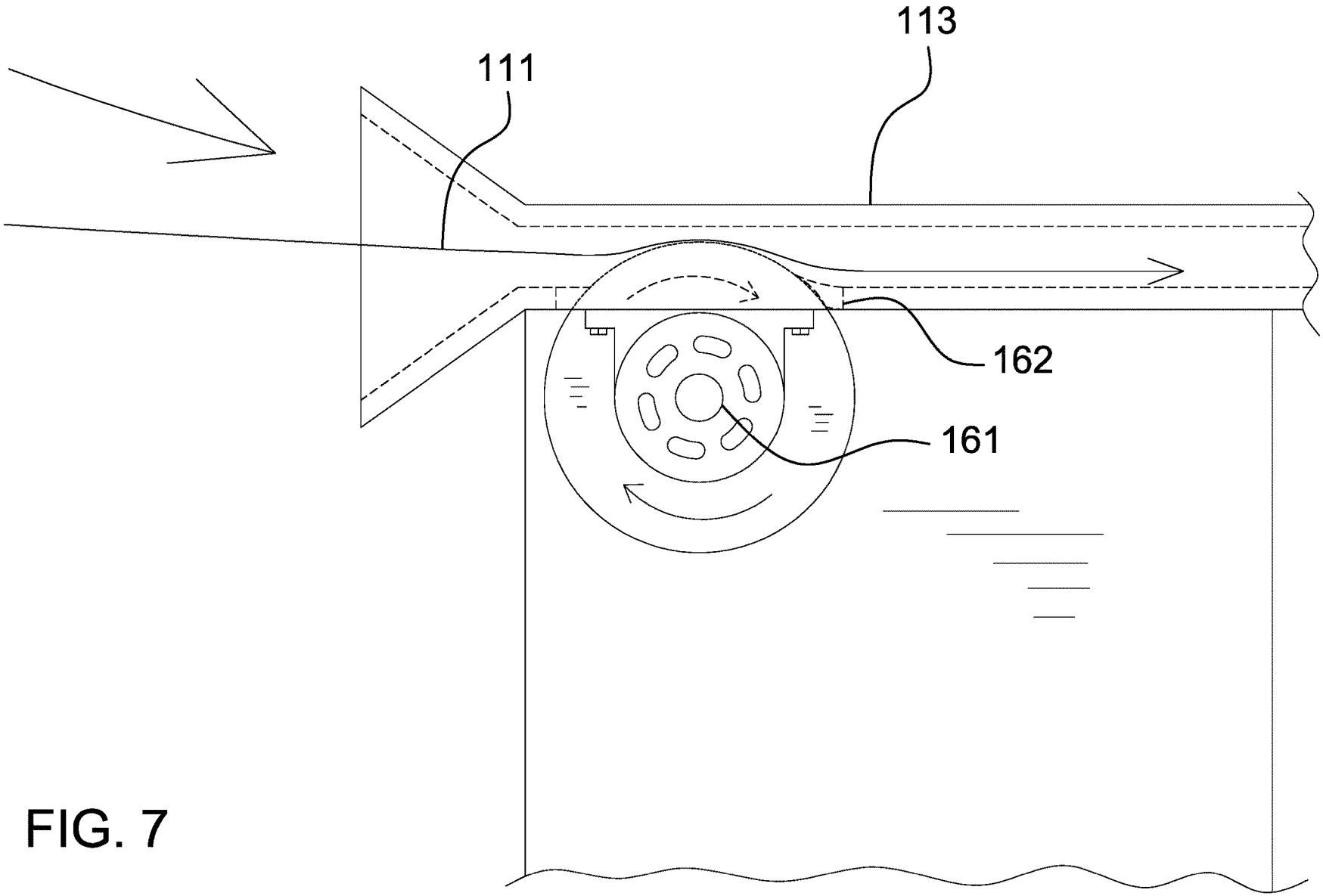
FIG. 7 is a detail view of an embodiment of the disclosure.
Figure 8:
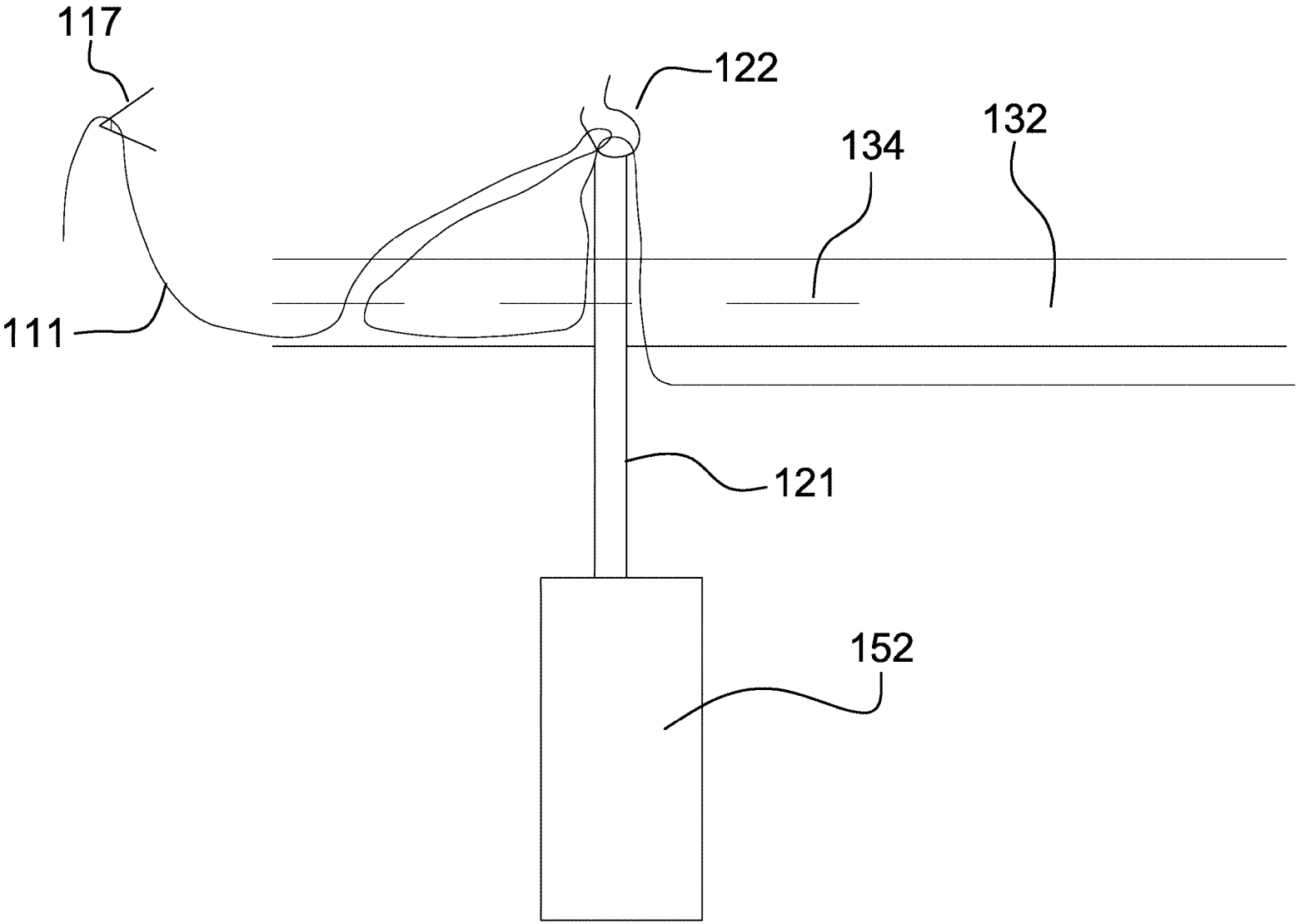
FIG. 8 is a detail view of an embodiment of the disclosure.
Figure 9:
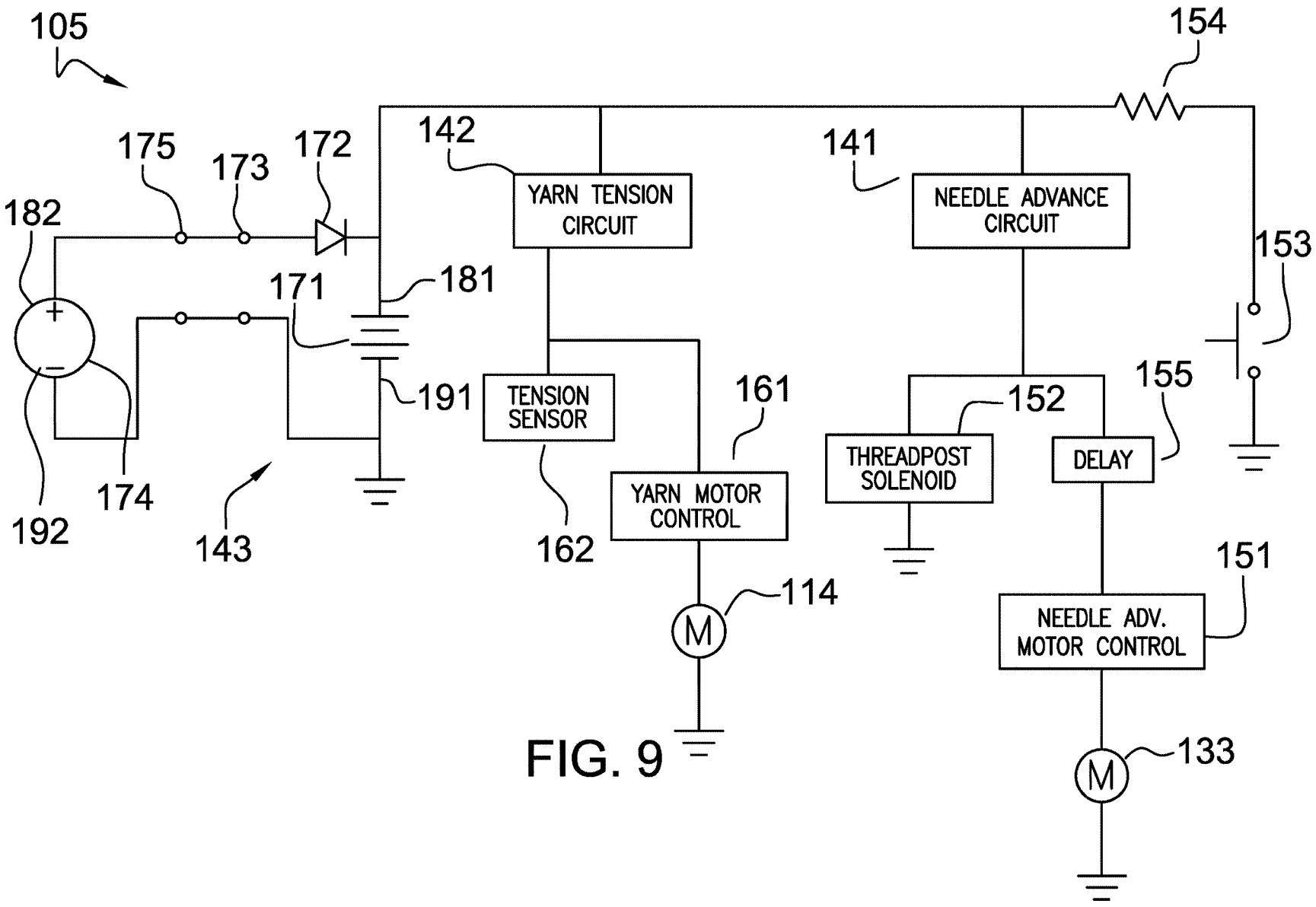
FIG. 9 is a schematic view of an embodiment of the disclosure.

Detailed reference will now be made to one or more potential embodiments of the disclosure, which are illustrated in FIGS. 1 through 9.

The needle-threading device 100 (hereinafter invention) is a mechanical device. The invention 100 is configured for use with a plurality of weave needles 131. Each individual weave needle 134 selected from the plurality of weave needles 131 is configured for use in sewing hair weaves. The invention 100 stores the plurality of weave needles 131 and automatically threads each individual weave needle 134 with a yarn 111, and individually dispenses each threaded individual weave needle 134 as required during the hair weaving process. Each individual weave needle 134 further comprises an eyelet structure 135.

The invention 100 comprises a yarn 111 feed 101, a threading mechanism 102, a needle mechanism 103, a housing 104, and a control circuit 105. The housing 104 contains the yarn 111 feed 101, the threading mechanism 102, the needle mechanism 103, and the control circuit 105.

The control circuit 105 controls the operation of the yarn 111 feed 101, the threading mechanism 102, and the needle mechanism 103. The yarn 111 feed 101 provisions the yarn 111 required to thread each individual weave needle 134. The needle mechanism 103: a) positions each individual weave needle 134 to receive the yarn 111 during the threading process; and, b) dispenses each individual weave needle 134 as required during the hair weaving process. The threading mechanism 102 threads the yarn 111 through the individual weave needle 134.

The housing 104 is a rigid casing. The housing 104 contains the yarn 111 feed 101, the threading mechanism 102, the needle mechanism 103, and the control circuit 105. The housing 104 is formed with all apertures and form factors necessary to allow the housing 104 to accommodate the use and operation of the yarn 111 feed 101, the threading mechanism 102, the needle mechanism 103, and the control circuit 105. Methods to form a housing 104 suitable for the purposes described in this disclosure are well-known and documented in the mechanical arts.

The yarn 111 feed 101 is a mechanical device. The yarn 111 feed 101 stores the yarn 111 used to thread each individual weave needle 134 contained in the plurality of weave needles 131. The yarn 111 feed 101 transports the yarn 111 to the threading mechanism 102 and the needle mechanism 103. The yarn 111 feed 101 controls the tension of the yarn 111 as it passes through the threading mechanism 102 and the needle mechanism 103. The control circuit 105 controls the tension of the yarn 111 dispensed by the yarn 111 feed 101. The yarn 111 feed 101 comprises a yarn 111, a yarn 111 spool 112, a yarn 111 track 113, a yarn 111 motor 114, and a yarn 111 cutter 115.

The yarn 111 is a cord used to secure a hair extension into a hair weave. The yarn 111 is threaded through each of the plurality of weave needles 131 sequentially. The yarn 111 is defined elsewhere in this disclosure. The yarn 111 spool 112 is a spool structure that stores the yarn 111. The spool is defined elsewhere in this disclosure. The yarn 111 feed 101 draws the yarn 111 directly from the yarn 111 spool 112.

The yarn 111 track 113 is a mechanical structure. The yarn 111 track 113 guides the motion of the yarn 111 through the housing 104 from the yarn 111 motor 114 to the threading mechanism 102. The yarn 111 track 113 is a prism-shaped structure that is formed as a c-channel. The c-channel is defined elsewhere in this disclosure. The yarn 111 threads through the hollow interior space formed by the c-channel.

The yarn 111 motor 114 is a servo motor. The control circuit 105 controls the operation of the yarn 111 motor 114. The control circuit 105 controls the speed of rotation and the direction of rotation of the yarn 111 motor 114 to control the tension of the yarn 111 as it passes through the yarn 111 feed 101.

The yarn 111 cutter 115 is a tool. The yarn 111 cutter 115 cuts the yarn 111 each time that an individual weave needle 134 selected from the plurality of weave needles 131 is removed from the invention 100. The yarn 111 cutter 115 secures the free end of the yarn 111 that remains after the selected individual weave needle 134 has been removed from the invention 100. The yarn 111 cutter 115 further comprises a yarn 111 blade 116 and a yarn 111 clip 117.

The yarn 111 blade 116 forms a part of the working element of the yarn 111 cutter 115. The yarn 111 blade 116 forms a cutting blade that cuts the yarn 111 as the selected individual weave needle 134 is removed from the invention 100. The yarn 111 clip 117 forms a part of the working element of the yarn 111 cutter 115. The clip is defined elsewhere in this disclosure. The yarn 111 clip 117 is a fastening structure. The yarn 111 clip 117 captures the yarn 111 as it is cut from the dispensed individual weave needle 134. The yarn 111 clip 117 ensures that both ends of the yarn 111 remain under the tension control of the yarn 111 feed 101 as the yarn 111 passes through the invention 100.

The threading mechanism 102 is a mechanical device. The control circuit 105 controls the operation of the threading mechanism 102. The threading mechanism 102 threads the yarn 111 through the eyelet structure 135 of each individual weave needle 134 contained in the plurality of weave needles 131. The threading mechanism 102 comprises a threading post 121 and a threading yarn 111 hook 122.

The threading post 121 is a mechanical structure. The threading post 121 is a prism-shaped structure. The control circuit 105 controls the movement of the threading post 121. The threading post 121 is positioned such that the center axis of the threading post 121 is aligned with the center of the negative space of the ring structure that forms the eyelet structure 135 of an individual weave needle 134 selected from the plurality of weave needles 131. The threading post 121 is sized such that the control circuit 105 inserts the threading post 121 through the eyelet structure 135 of the individual weave needle 134. The yarn 111 is positioned between the threading post 121 and the eyelet structure 135 of the individual weave needle 134 such that the threading post 121 pushes the yarn 111 through the eyelet structure 135 to thread the individual weave needle 134.

The threading yarn 111 hook 122 is a hook structure. The threading yarn 111 hook 122 is positioned within the invention 100 such that the threading yarn 111 hook 122 captures the yarn 111 after the threading post 121 has inserted the yarn 111 through the eyelet structure 135 of the individual weave needle 134. The threading yarn 111 hook 122 ensures that the yarn 111 remains threaded through the individual weave needle 134 until the yarn 111 is cut by the yarn 111 cutter 115 as the individual weave needle 134 is dispensed from the invention 100.

The needle mechanism 103 is a mechanical device. The needle mechanism 103 stores the plurality of weave needles 131 in preparation for threading and dispensing. The needle mechanism 103 moves the plurality of weave needles 131 through the housing 104 during the preparation for threading and dispensing processes. The needle mechanism 103 comprises a plurality of weave needles 131, a weaving needle track 132, and a weaving needle advance motor 133.

Each of the plurality of weave needles 131 is a sewing needle. Each of the plurality of weave needles 131 is identical. Each of the plurality of weave needles 131 weaves a hair extension into a hair weave. Each of the plurality of weave needles 131 passes the yarn 111 through the hair weave in order to secure the hair extension into the hair weave. The plurality of weave needles 131 comprises a collection of individual weave needles 134.

The individual weave needle 134 forms a mechanical structure that draws the yarn 111 through the hair extensions and the hair weave as a hair extension is incorporated into the hair weave. The use of an individual weave needle 134 for this purpose is well-known and documented in the sewing, apparel, and textile arts. Each individual weave needle 134 further comprises an eyelet structure 135.

The eyelet structure 135 is an eyelet that is formed through the individual weave needle 134. The eyelet is defined elsewhere in this disclosure. The eyelet structure 135 is a ring structure. The negative space formed by the ring structure of the eyelet structure 135 is sized to receive both the threading post 121 of the threading mechanism 102 and the yarn 111 during the threading process.

The weaving needle track 132 is a track system. The weaving needle track 132 secures the plurality of weave needles 131 into the needle mechanism 103 such that the orientation of each individual weave needle 134 selected from the plurality of weave needles 131 is identical. The weaving needle track 132 secures the plurality of weave needles 131 into the needle mechanism 103 such that the span of the distance between any two adjacent individual weave needles 134 selected from the plurality of weave needles 131 are identical. The weaving needle track 132 guides the path of each of the plurality of weave needles 131 as the plurality of weave needles 131 moves through the invention 100.

The weaving needle advance motor 133 is a servo motor. The weaving needle advance motor 133 controls the distance each of the plurality of weave needles 131 move along the weaving needle track 132. The control circuit 105 controls the operation of the weaving needle advance motor 133. The control circuit 105 controls the speed of rotation and the direction of rotation of the weaving needle advance motor 133. The control circuit 105 stops the motion of the weaving needle advance motor 133 when an eyelet structure 135 of the individual weave needle 134 aligns with the threading post 121 of the threading mechanism 102.

The control circuit 105 is an electric circuit. The control circuit 105 controls the operation of the yarn 111 feed 101. Specifically, the control circuit 105 controls the tension of the yarn 111 as it passes through the threading mechanism 102 and the needle mechanism 103. The control circuit 105 controls the operation of the threading mechanism 102 and the needle mechanism 103. Specifically, the control circuit 105: a) initiates the process of threading the yarn 111 through an individual weave needle 134 selected from the plurality of weave needles 131; and, b) initiates the movement of the plurality of weave needles 131 such that an individual weave needle 134 selected from the plurality of weave needles 131 is properly aligned with the threading mechanism 102 for the threading process. The control circuit 105 is an independently powered electric circuit. By independently powered is meant that the control circuit 105 can operate without an electrical connection to an external power source 174.

The control circuit 105 comprises an advance circuit 141, a yarn 111 tension circuit 142, and a power circuit 143. The advance circuit 141, the yarn 111 tension circuit 142, and the power circuit 143 are electrically interconnected.

The advance circuit 141 is an electric circuit. The advance circuit 141 controls the operation of the threading mechanism 102. The advance circuit 141 provides the motive forces necessary to insert the threading post 121 and the yarn 111 through the eyelet structure 135 of each individual weave needle 134 selected from the plurality of weave needles 131. The advance circuit 141 controls the operation of the weaving needle advance motor 133 of the needle mechanism 103. The advance circuit 141 controls the speed of rotation and the direction of rotation of the weaving needle advance motor 133. The advance circuit 141 provides the electrical energy necessary to operate the weaving needle advance motor 133. The advance circuit 141 inserts a timed delay 155 between the initiation of the operation of the threading post 121 of the threading mechanism 102 and the initiation of the operation of the weaving needle advance motor 133 of the needle mechanism 103.

The advance circuit 141 comprises a weaving needle advance motor 133 controller 151, a threading solenoid 152, a momentary switch 153, and a delay 155. The momentary switch 153 further comprises a pull-up resistor 154. The weaving needle advance motor 133 controller 151, the threading solenoid 152, the momentary switch 153, the pull-up resistor 154, and the delay 155 are electrically interconnected.

The weaving needle advance motor 133 controller 151 is an electric circuit. The weaving needle advance motor 133 controller 151 is a motor controller used to control the operation of the weaving needle advance motor 133. The motor controller is defined elsewhere in this disclosure. The advance circuit 141 controls the operation of the weaving needle advance motor 133 controller 151. The weaving needle advance motor 133 controller 151 converts control signals received from the advance circuit 141 into the voltages and electric current necessary to operate the weaving needle advance motor 133 at the direction of rotation and the speed of rotation necessary for the proper operation of the invention 100.

The threading solenoid 152 is a solenoid. The solenoid is defined elsewhere in this disclosure. The advance circuit 141 controls the operation of the threading solenoid 152. The threading post 121 attaches to the moving shaft of the threading solenoid 152 to form a composite prism structure. The threading solenoid 152 provides the motive forces necessary to insert the threading post 121 and the yarn 111 through the eyelet structure 135 of any individual weave needle 134 selected from the plurality of weave needles 131.

The momentary switch 153 is an electric switch. The momentary switch 153 is defined elsewhere in this disclosure. The momentary switch 153 presents an electric voltage to the advance circuit 141. The advance circuit 141 initiates the operations of the threading mechanism 102 and the needle mechanism 103 when the momentary switch 153 is actuated to a closed position. The pull-up resistor 154 is an electric circuit element. The pull-up resistor 154 electrically connects between the power circuit 143 and the momentary switch 153. The pull-up resistor 154 controls the flow of electricity through the momentary switch 153.

The delay 155 is a timing circuit that forms a timing device. The timing circuit and timing device are defined elsewhere in this disclosure. The delay 155 delays the initiation of the operation of the weaving needle advance motor 133 controller 151 until threading solenoid 152 has completed the threading process.

The yarn 111 tension circuit 142 is an electric circuit. The yarn 111 tension circuit 142 controls the operation of the yarn 111 feed 101. The yarn 111 tension circuit 142 measures the tension of the yarn 111 as it passes through the yarn 111 feed 101. The yarn 111 tension circuit 142 controls the speed of rotation and the direction of rotation of the yarn 111 motor 114 such that the yarn 111 maintains a constant tension as it passes through the yarn 111 feed 101. The yarn 111 tension circuit 142 comprises a yarn 111 motor 114 controller 161 and a tension sensor 162. The yarn 111 motor 114 controller 161 and the tension sensor 162 are electrically interconnected.

The yarn 111 motor 114 controller 161 is an electric circuit. The yarn 111 motor 114 controller 161 is a motor controller used to control the operation of the yarn 111 motor 114. The motor controller is defined elsewhere in this disclosure. The yarn 111 tension circuit 142 controls the operation of the yarn 111 motor 114 controller 161. The yarn 111 motor 114 controller 161 converts control signals received from the yarn 111 tension circuit 142 into the voltages and electric current necessary to operate the yarn 111 motor 114 at the direction of rotation and the speed of rotation necessary to maintain the proper tension on the yarn 111 as it passes through the yarn 111 feed 101.

The tension sensor 162 is an electrical device. The tension sensor 162 measures the tension on the yarn 111 as it passes through the yarn 111 feed 101. The tension sensor 162 converts the measured tension into an electric signal that is transmitted to the yarn 111 tension circuit 142. The yarn 111 tension circuit 142 converts the received electric signal into the control signals necessary to allow the yarn 111 motor 114 controller 161 to control the yarn 111 motor 114 in a manner that maintains a proper tension on the yarn 111 as it passes through the yarn 111 feed 101.

The power circuit 143 is an electrical circuit. The power circuit 143 powers the operation of the control circuit 105. The power circuit 143 is an electrochemical device. The power circuit 143 converts chemical potential energy into the electrical energy required to power the control circuit 105. The power circuit 143 comprises a battery 171, a diode 172, a charging port 173, and an external power source 174. The external power source 174 further comprises a charging plug 175. The battery 171, the diode 172, the charging port 173, the external power source 174, and the charging plug 175 are electrically interconnected. The battery 171 further comprises a first positive terminal 181 and a first negative terminal 191. The external power source 174 further comprises a second positive terminal 182 and a second negative terminal 192.

The battery 171 is an electrochemical device. The battery 171 converts chemical potential energy into the electrical energy used to power the control circuit 105. The battery 171 is a commercially available rechargeable battery 171. The chemical energy stored within the rechargeable battery 171 is renewed and restored through the use of the charging port 173. The charging port 173 is an electrical circuit that reverses the polarity of the rechargeable battery 171 and provides the energy necessary to reverse the chemical processes that the rechargeable battery 171 initially used to generate the electrical energy. This reversal of the chemical process creates a chemical potential energy that will later be used by the rechargeable battery 171 to generate electricity.

The charging port 173 forms an electrical connection to an external power source 174 using a charging plug 175. The charging plug 175 forms a detachable electrical connection with the charging port 173. The charging port 173 receives electrical energy from the external power source 174 through the charging plug 175. The diode 172 is an electrical device that allows current to flow in only one direction. The diode 172 installs between the rechargeable battery 171 and the charging port 173 such that electricity will not flow from the first positive terminal 181 of the rechargeable battery 171 into the second positive terminal 191 of the external power source 174.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Automatic: As used in this disclosure, automatic refers to a device, process, or a system that operates without human control, supervision or participation in the operation of the device, process, or system. The verb form of automatic is to automate.

Battery: As used in this disclosure, a battery is a chemical device consisting of one or more cells, in which chemical energy is converted into electricity and used as a source of power. Batteries are commonly defined with a positive terminal and a negative terminal.

Blade: As used in this disclosure, a blade is a term that is used to describe: 1) a wide and flat portion of a structure; or, 2) the cutting edge of a tool.

C-Channel: As used in this disclosure, the C-channel is a structure that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clip: As used in this disclosure, a clip is a fastener that attaches to an object by gripping or clasping the object. A clip is typically spring loaded.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Curve or Curvature: As used in this disclosure, a curve refers to a continuous line that is not a straight line or a continuous surface that is not a planar surface. By continuous is meant that the continuous line or surface changes smoothly over one or more independent variables. Alternately, continuous can be taken to mean that a single valued derivative with respect to any independent variable exists for all points on the curved line or curved surface. A note on usage: within this disclosure, when a prism is said to be curved, what will be meant is that the center axis of the prism is curved. The discontinuities inherent in the ends of the prism will continue to exist in the lateral face of the curved prism.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Eyelet: As used in this disclosure, an eyelet is a ring-shaped mechanical structure intended to have a cord passed through the aperture of the ring structure.

Feedback: As used in this disclosure, feedback refers to a system, including engineered systems, or a subsystem further comprising an "input" and an "output" wherein the difference between the output of the engineered system or subsystem and a reference is used as, or fed back into, a portion of the input of the system or subsystem. Examples of feedback in engineered systems include, but are not limited to, a fluid level control device such as those typically used in a toilet tank, a cruise control in an automobile, a fly ball governor, a thermostat, and almost any electronic device that comprises an amplifier. Feedback systems in nature include, but are not limited to, thermal regulation in animals and blood clotting in animals (wherein the platelets involved in blood clotting release chemical to attract other platelets)

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook: As used in this disclosure, a hook is an object that is curved or bent at an angle such that items can be hung on or caught by the object.

Housing: As used in this disclosure, a housing is a rigid structure that encloses and protects one or more devices.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed of the motor, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pull-Up Resistor: As used in this disclosure, a pull-up resistor is an electrical resistor that is used to: 1) limit the current flow through a switching device; and, 2) to control the voltage level presented across a switch, a load resistor, or a pull-down resistor.

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rigid Structure: As used in this disclosure, a rigid structure is a solid structure formed from an inelastic material that resists changes in shape. A rigid structure will permanently deform as it fails under a force. See bimodal flexible structure.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Servo Motor: As used in this disclosure, a servo motor is an electrical motor that further incorporates a feedback circuit that allows for the precise angular positioning of the electric motor.

Solenoid: As used in this disclosure, a solenoid is a cylindrical coil of electrical wire that generates a magnetic field that can be used to mechanically move a shaft made of a magnetic core.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tension: As used in this disclosure, tension refers to a force applied to an object such that the force will stretch the span of length of the object along the direction of the force.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry. The "555" timing circuit is a well-known, documented, and commercially available timing circuit.

Timing Device: As used in this disclosure, a timing device is an automatic mechanism for activating or deactivating a device at a specific time or after a specific period of time. This disclosure assumes that the logic module is provisioned with a timing circuit that can be used as a timing device. A timing device that activates an audible alarm is often referred to as a timer.

Tool: As used in this disclosure, a tool is a device, an apparatus, or an instrument that is used to carry out an activity, operation, or procedure.

Track: As used in this disclosure, a track is a device that is used to control the path of motion of an object in at least one dimension and in a maximum of two dimensions.

Working Element: As used in this disclosure, the working element of a tool is the physical element on the tool that performs the actual activity, operation, or procedure the tool is designed to perform. For example, the cutting edge of a blade is the working element of a knife.

Yarn: As used in this disclosure, a yarn is a continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A needle-threading device comprising a yarn feed, a threading mechanism, a needle mechanism, a housing, a control circuit, and a plurality of weave needles;

wherein the housing contains the yarn feed, the threading mechanism, the needle mechanism, and the control circuit;

wherein the control circuit controls the operation of the yarn feed, the threading mechanism, and the needle mechanism;

wherein each individual weave needle of the plurality of weave needles further comprises an eyelet structure;

wherein the needle-threading device stores the plurality of weave needles and automatically threads each individual weave needle with a yarn, and individually dispenses each threaded individual weave needle;

wherein the yarn feed provisions the yarn required to thread each individual weave needle;

wherein the needle mechanism: a) positions each individual weave needle to receive the yarn during the threading process; and, b) dispenses each individual weave needle as required during the hair weaving process;

wherein the threading mechanism threads the yarn through the individual weave needle;

wherein the yarn feed stores the yarn used to thread each individual weave needle contained in the plurality of weave needles;

wherein the yarn feed transports the yarn to the threading mechanism and the needle mechanism;

wherein the yarn feed controls a tension of the yarn as it passes through the threading mechanism and the needle mechanism;

wherein the control circuit controls the tension of the yarn dispensed by the yarn feed;

wherein the control circuit controls the operation of the threading mechanism;

wherein the threading mechanism threads the yarn through the eyelet structure of each individual weave needle contained in the plurality of weave needles;

wherein the needle mechanism stores the plurality of weave needles in preparation for threading and dispensing;

wherein the needle mechanism moves the plurality of weave needles through the housing during the preparation for threading and dispensing processes.

2. The needle-threading device according to claim 1 wherein the control circuit is an electric circuit;

wherein the control circuit controls the operation of the yarn feed;

wherein the control circuit controls the tension of the yarn as it passes through the threading mechanism and the needle mechanism;

wherein the control circuit controls the operation of the threading mechanism and the needle mechanism;

wherein specifically, the control circuit: a) initiates the process of threading the yarn through an individual weave needle selected from the plurality of weave needles; and, b) initiates the movement of the plurality of weave needles such that an individual weave needle selected from the plurality of weave needles is properly aligned with the threading mechanism for the threading process;

wherein the control circuit is an independently powered electric circuit;

wherein by independently powered is meant that the control circuit can operate without an electrical connection to an external power source.

3. The needle-threading device according to claim 2 wherein the yarn feed comprises a yarn, a yarn spool, a yarn track, a yarn motor, and a yarn cutter;

wherein the yarn is a cord;

wherein the yarn spool is a spool structure that stores the yarn;

wherein the yarn track guides a motion of the yarn through the housing from the yarn motor to the threading mechanism;

wherein the yarn motor controls the tension of the yarn as it passes through the yarn feed;

wherein the yarn cutter cuts the yarn each time that an individual weave needle selected from the plurality of weave needles is removed from the needle-threading device.

4. The needle-threading device according to claim 3 wherein the threading mechanism comprises a threading post and a threading yarn hook;

wherein the threading post inserts the yarn through the eyelet structure of an individual weave needle;

wherein the threading yarn hook is a hook structure;

wherein the threading yarn hook is positioned within the needle-threading device such that the threading yarn hook captures the yarn after the threading post has inserted the yarn through the eyelet structure of the individual weave needle.

5. The needle-threading device according to claim 4 wherein the needle mechanism comprises a plurality of weave needles, a weaving needle track, and a weaving needle advance motor;

wherein each of the plurality of weave needles is a sewing needle;

wherein each of the plurality of weave needles is identical;

wherein the plurality of weave needles comprises a collection of individual weave needles;

wherein the individual weave needle forms a mechanical structure that draws yarn;

wherein the weaving needle track is a track system;

wherein the weaving needle track guides a path of each of the plurality of weave needles as the plurality of weave needles moves through the needle-threading device;

wherein the weaving needle advance motor controls a distance each of the plurality of weave needles move along the weaving needle track.

6. The needle-threading device according to claim 5 wherein the eyelet structure is a ring structure;

wherein a negative space formed by the ring structure of the eyelet structure is sized to receive both the threading post of the threading mechanism and the yarn during the threading process.

7. The needle-threading device according to claim 6 wherein the control circuit comprises an advance circuit, a yarn tension circuit, and a power circuit;

wherein the advance circuit, the yarn tension circuit, and the power circuit are electrically interconnected;

wherein the advance circuit is an electric circuit;

wherein the advance circuit controls the operation of the threading mechanism;

wherein the advance circuit provides motive forces necessary to insert the threading post and the yarn through the eyelet structure of each individual weave needle selected from the plurality of weave needles;

wherein the advance circuit controls the operation of the weaving needle advance motor of the needle mechanism;

wherein the advance circuit controls a speed of rotation and a direction of rotation of the weaving needle advance motor;

wherein the advance circuit provides electrical energy necessary to operate the weaving needle advance motor;

wherein the advance circuit inserts a timed delay between initiation of the operation of the threading post of the threading mechanism and initiation of the operation of the weaving needle advance motor of the needle mechanism;

wherein the yarn tension circuit is an electric circuit;

wherein the yarn tension circuit controls the operation of the yarn feed;

wherein the yarn tension circuit measures the tension of the yarn as it passes through the yarn feed;

wherein the yarn tension circuit controls the speed of rotation and the direction of rotation of the yarn motor such that the yarn maintains a constant tension as it passes through the yarn feed;

wherein the power circuit is an electrical circuit;

wherein the power circuit powers the operation of the control circuit;

wherein the power circuit is an electrochemical device.

8. The needle-threading device according to claim 7 wherein the yarn is threaded through each of the plurality of weave needles sequentially;

wherein the yarn feed draws the yarn directly from the yarn spool;

wherein the yarn track is a mechanical structure;

wherein the yarn track is a prism-shaped structure that is formed as a c-channel;

wherein the yarn threads through the hollow interior space formed by the c-channel;

wherein the yarn motor is a servo motor;

wherein the control circuit controls the operation of the yarn motor;

wherein the control circuit controls speed of rotation and direction of rotation of the yarn motor to control the tension of the yarn as it passes through the yarn feed;

wherein the yarn cutter is a tool;

wherein the yarn cutter secures a free end of the yarn that remains after the selected individual weave needle has been removed from the needle-threading device.

9. The needle-threading device according to claim 8 wherein the yarn cutter further comprises a yarn blade and a yarn clip;

wherein the yarn blade forms a part of the working element of the yarn cutter;

wherein the yarn blade forms a cutting blade that cuts the yarn as the selected individual weave needle is removed from the needle-threading device;

wherein the yarn clip forms a part of the working element of the yarn cutter;

wherein the yarn clip is a fastening structure;

wherein the yarn clip captures the yarn as the yarn is cut from the dispensed individual weave needle;

wherein the yarn clip ensures that both ends of the yarn remain under the tension control of the yarn feed as the yarn passes through the needle-threading device.

10. The needle-threading device according to claim 9 wherein the threading post is a mechanical structure;

wherein the threading post is a prism-shaped structure;

wherein the control circuit controls the movement of the threading post;

wherein the threading post is positioned such that a center axis of the threading post is aligned with a center of the negative space of the ring structure that forms the eyelet structure of an individual weave needle selected from the plurality of weave needles;

wherein the threading post is sized such that the control circuit inserts the threading post through the eyelet structure of the individual weave needle;

wherein the yarn is positioned between the threading post and the eyelet structure of the individual weave needle such that the threading post pushes the yarn through the eyelet structure to thread the individual weave needle.

11. The needle-threading device according to claim 10 wherein the weaving needle track secures the plurality of weave needles into the needle mechanism such that the orientation of each individual weave needle selected from the plurality of weave needles is identical;

wherein the weaving needle track secures the plurality of weave needles into the needle mechanism such that the span of the distance between any two adjacent individual weave needles selected from the plurality of weave needles are identical.

12. The needle-threading device according to claim 11 wherein the weaving needle advance motor is a servo motor;

wherein the control circuit controls the operation of the weaving needle advance motor;

wherein the control circuit controls the speed of rotation and the direction of rotation of the weaving needle advance motor;

wherein the control circuit stops the motion of the weaving needle advance motor when an eyelet structure of the individual weave needle aligns with the threading post of the threading mechanism.

13. The needle-threading device according to claim 11 wherein the advance circuit comprises a weaving needle advance motor controller, a threading solenoid, a momentary switch, and a delay;

wherein the momentary switch further comprises a pull-up resistor;

wherein the weaving needle advance motor controller, the threading solenoid, the momentary switch, the pull-up resistor, and the delay are electrically interconnected;

wherein the yarn tension circuit comprises a yarn motor controller and a tension sensor;

wherein the yarn motor controller and the tension sensor are electrically interconnected;

wherein the power circuit comprises a battery, a diode, a charging port, and an external power source;

wherein the external power source further comprises a charging plug;

wherein the battery, the diode, the charging port, the external power source, and the charging plug are electrically interconnected;

wherein the battery further comprises a first positive terminal and a first negative terminal;

wherein the external power source further comprises a second positive terminal and a second negative terminal.

14. The needle-threading device according to claim 13 wherein the weaving needle advance motor controller is an electric circuit;

wherein the weaving needle advance motor controller is a motor controller used to control the operation of the weaving needle advance motor;

wherein the advance circuit controls the operation of the weaving needle advance motor controller;

wherein the weaving needle advance motor controller converts control signals received from the advance circuit into the voltages and electric current necessary to operate the weaving needle advance motor at the direction of rotation and the speed of rotation necessary for the proper operation of the needle-threading device;

wherein the threading solenoid is a solenoid;

wherein the advance circuit controls the operation of the threading solenoid;

wherein the threading post attaches to the moving shaft of the threading solenoid to form a composite prism structure;

wherein the threading solenoid provides the motive forces necessary to insert the threading post and the yarn through the eyelet structure of any individual weave needle selected from the plurality of weave needles;

wherein the momentary switch is an electric switch;

wherein the momentary switch presents an electric voltage to the advance circuit;

wherein the advance circuit initiates the operations of the threading mechanism and the needle mechanism when the momentary switch is actuated to a closed position;

wherein the pull-up resistor is an electric circuit element;

wherein the pull-up resistor electrically connects between the power circuit and the momentary switch;

wherein the pull-up resistor controls the flow of electricity through the momentary switch;

wherein the delay is a timing circuit that forms a timing device;

wherein the delay delays the initiation of the operation of the weaving needle advance motor controller until threading solenoid has completed the threading process.

15. The needle-threading device according to claim 14 wherein the yarn motor controller is an electric circuit;

wherein the yarn motor controller is a motor controller used to control the operation of the yarn motor;

wherein the yarn tension circuit controls the operation of the yarn motor controller;

wherein the yarn motor controller converts control signals received from the yarn tension circuit into the voltages and electric current necessary to operate the yarn motor at the direction of rotation and the speed of rotation necessary to maintain the proper tension on the yarn as it passes through the yarn feed;

wherein the tension sensor is an electrical device;

wherein the tension sensor measures the tension on the yarn as it passes through the yarn feed;

wherein the tension sensor converts the measured tension into an electric signal that is transmitted to the yarn tension circuit;

wherein the yarn tension circuit converts the received electric signal into the control signals necessary to allow the yarn motor controller to control the yarn motor in a manner that maintains a proper tension on the yarn as it passes through the yarn feed.

16. The needle-threading device according to claim 15 wherein the battery is a rechargeable battery;

wherein the charging port is an electrical circuit that reverses the polarity of the rechargeable battery and provides the energy necessary to reverse the chemical processes that the rechargeable battery initially used to generate the electrical energy;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

* * * * *